US007134665B2

(12) United States Patent
Holsten et al.

(10) Patent No.: US 7,134,665 B2
(45) Date of Patent: Nov. 14, 2006

(54) BALLOON BURSTING GAME

(76) Inventors: William A. Holsten, 16 Twin Oaks Rd., Parsippany, NJ (US) 07054; Janet A. Holsten, 16 Twin Oaks Rd., Parsippany, NJ (US) 07054

( * ) Notice: Subject to any disclaimer, the term of this patent is extended or adjusted under 35 U.S.C. 154(b) by 99 days.

(21) Appl. No.: 10/906,132

(22) Filed: Feb. 3, 2005

(65) Prior Publication Data

US 2006/0175760 A1 Aug. 10, 2006

(51) Int. Cl.
*A63F 9/00* (2006.01)

(52) U.S. Cl. ..... 273/458; 273/459

(58) Field of Classification Search ..... 273/440, 273/457, 458, 459; 446/220, 224
See application file for complete search history.

(56) References Cited

U.S. PATENT DOCUMENTS 3,861,684 A * 1/1975 Gastin et al. ..... 273/287
4,171,806 A * 10/1979 Goldfarb et al. ..... 273/458
5,324,045 A * 6/1994 Trawick et al. ..... 273/458
5,433,644 A * 7/1995 Cheng ..... 446/224
6,402,582 B1 * 6/2002 Sherer ..... 446/220

* cited by examiner

*Primary Examiner*—Raleigh W. Chiu

(57) ABSTRACT

A balloon-bursting game for providing amusement to individuals at events by striking a pneumatic striker to inflate the balloon until it bursts. The inventive device includes a striker mechanism for pneumatically compressing air into an air tube when struck or depressed, a vertical shaft comprised of a base structure and housing, a balloon nozzle and piercing frame attached to the top of the vertical shaft, and an air tube connected by a nozzle from the striker mechanism through a monodirectional controlling valve and housing to the bottom end of the balloon nozzle. In use, with an uninflated balloon secured to the balloon nozzle, a hammer or similar object, or means of jumping up and down upon the striker mechanism, repeatedly depresses the striker mechanism, forcing air through the tube, valve and nozzle into the balloon, so that the balloon expands to a size sufficient to press against the piercing frame and burst.

8 Claims, 6 Drawing Sheets

BALLOON BURSTING GAME

FIELD OF THE INVENTION

The present invention relates to balloon bursting game devices and more specifically it relates to a balloon bursting game for providing amusement to individuals at events by striking a pneumatic striker to inflate the balloon until the balloon bursts.

DESCRIPTION OF PRIOR ART

Games that burst balloons or other elastic members are well known and are considered enjoyable pastimes by most. Typically, the games involve mechanical and manual bursting of previously inflated balloons by puncturing them with sharpened objects, or applying pressure, or both; or employing a variety of means to inflate balloons so that they may burst or fly away.

U.S. Pat. No. 4,881,773 to Rehkember et al (1989) describes a game in which a balloon or expandable object is mechanically burst at planned or random times while the balloon containing object is tossed from one person to another. A different game described in U.S. Pat. No. 4,826,161 to Rookmaaker (1989) involves participants in bursting a balloon by having them insert "game members" of different lengths into pre-cut apertures of an enclosure wrapped around the balloon.

In U.S. Pat. No. 4,201,387 to Revermann et al (1980), the balloon is placed in a box, and players take turns turning a knob, which successively tightens pressure on the balloon until ultimately it bursts. In a related approach, U.S. Pat. No. 4,169,593 to Wood (1979) describes a boxed balloon which bursts when marbles weigh down sharpened members and pierce it.

A different approach is described in U.S. Pat. No. 4,538,817 to Ramella (1985), wherein inflated balloons are burst by sharpened projectiles thrown by competing players.

Another method of bursting or releasing inflatable bodies or balloons is to provide a means to increasingly inflate them until the action occurs. This is true in the case of U.S. Pat. No. 4,453,711 to Gin (1984), where two such inflatable bodies are placed in a supporting element and orally inflated using a mouthpiece, until the bodies expand sufficiently to reach a nail-like fixed piercing element and then burst. In U.S. Pat. No. 5,029,851 to Hagen (1991), a variable number of players orally blow up balloons attached to rigid tubing in a popping apparatus until they burst.

A variety of games and amusement devices use pumped air to inflate balloons and inflatable material. In U.S. Pat. No. 5,324,045 to Trawick et al (1994) a hand pump is used to inflate balloons when a player spins a spinner during his turn. A bellows is used to inflate the balloon in U.S. Pat. No. 4,171,806 to Goldfarb et al (1979), and when the balloon reaches sufficient size it thrusts game pieces in an outward direction like a gusher in an oil well, without actually causing the balloon to burst. The game in U.S. Pat. No. 4,149,338 to Wolf (1979) also employs a bellows to push air into a balloon held on by "elastometric washer"; when balloon pressure is high enough it releases itself and flies away, like a ladybug. In U.S. Pat. No. 5,261,850 to Barthold (1993) the bellows pump inflates pancake-shaped reusable flat elastic material held to a circular opening by a locking ring.

Previous toys and games have also employed sound with air chambers and air bladders when inflating balloons. U.S. Pat. No. 1,098,303 to Steiner et al (1914) involves pushing down on an air chamber to inflate balloons in a sounding figure toy. U.S. Pat. No. 2,776,530 to Baumgartner (1957) employs a balloon filling pump imbedded in a character head, and originated a special nozzle with substantially conical exterior with a series of annular stepped recesses to hold the balloon in place. The toy in U.S. Pat. No. 2,912,791 to Cohen (1959) employs a hard housing including expandable resilient bulb which when squeezed by pumping action, via an external handle or by hammering a peg, pushes air into a balloon and makes an entertaining whistling sound.

Additionally, many carnival games involve players using a hammer or maul to strike a striker to send a game member vertically up a guided path to strike a bell, physically or electronically.

While these devices may be suitable for the particular purpose to which they address, they are not as suitable for providing amusement to individuals at events by striking a pneumatic striker to inflate a balloon until it bursts.

SUMMARY OF THE INVENTION

In view of the limitations inherent in the known types of balloon bursting games now present in the prior art, the present invention provides a new balloon bursting game construction wherein the same can be utilized for providing amusement to individuals at events by striking a pneumatic striker to inflate the balloon until it bursts.

The general purpose of the present invention, which will be described subsequently in greater detail, it to provide a new balloon bursting game that has many of the advantages of the balloon bursting games mentioned heretofore and many novel features that result in a new balloon bursting game which is not anticipated, rendered obvious, suggested or even implied by any of the prior balloon bursting games, either alone or in any combination thereof.

To attain this, the present invention generally comprises a striker mechanism for pneumatically compressing air into an air tube when struck or depressed, a vertical shaft comprised of a base structure and housing, a balloon nozzle and piercing frame attached to the top of the vertical shaft, and an air tube connected by a nozzle from the striker mechanism through a monodirectional controlling valve and housing to the bottom end of the balloon nozzle. In use, with an uninflated balloon secured to the balloon nozzle, a hammer or similar object, or means of jumping up and down upon the striker mechanism, repeatedly depresses the pneumatic striker mechanism, forcing air through the tube, valve and nozzle into the balloon, so that the balloon expands to a size sufficient to press against the piercing frame and burst.

There has thus been outlined, rather broadly, the more important features of the invention in order that the detailed description thereof may be better understood, and in order that the present contribution to the art may be better appreciated. There are additional features of the invention that will be described hereinafter and will form the subject matter for the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is understood that the phraseology and terminology employed herein are for the purpose of the description and should not be regarded as limiting.

A primary object of the present invention is to provide a balloon bursting game that will overcome the shortcomings of the prior art devices.

A second object is to provide a balloon bursting game for providing amusement to individuals at events by striking a pneumatic striker to inflate the balloon until it bursts.

An additional object is to provide a balloon bursting game that when using two or more of the said games, competition can ensue as to which player can be first to burst their balloon.

Another object is to provide a balloon bursting game that is easy to construct and simple to maintain.

A further object is to provide a balloon bursting game that can be utilized by businesses, fund-raising organizations and at various events.

Another object is to provide a balloon bursting game that can be played by private individuals and children in play situations.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

SUMMARY OF THE DRAWINGS

Various other objects, features and attendant advantages of the present invention will become fully appreciated as the same becomes better understood when considered in conjunction with the accompanying drawings, in which like reference characters designate the same or similar parts through the several views, and wherein.

BRIEF DESCRIPTION OF THE DRAWINGS

Figure 1:
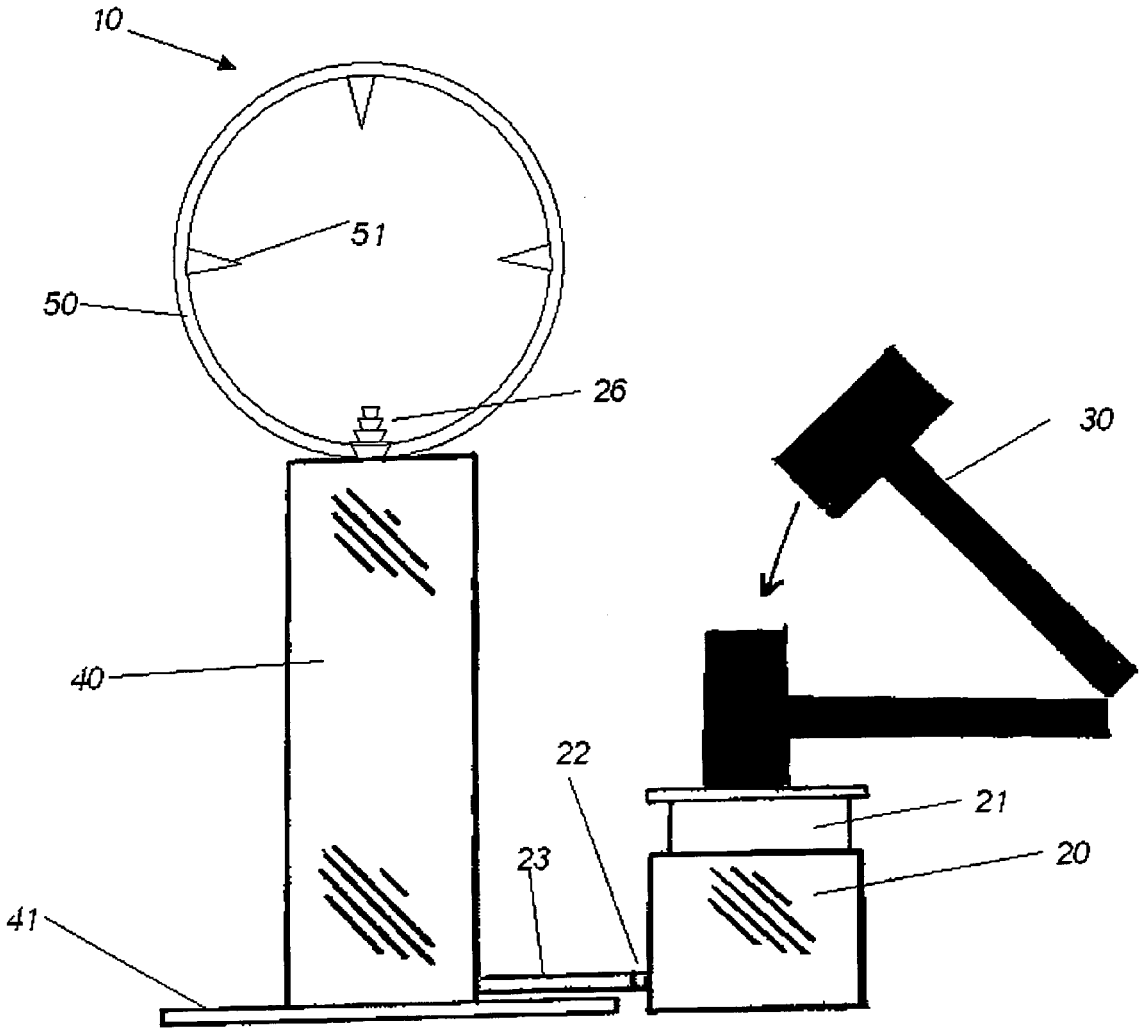
FIG. 1 is a side perspective view of the present invention.
Figure 2:
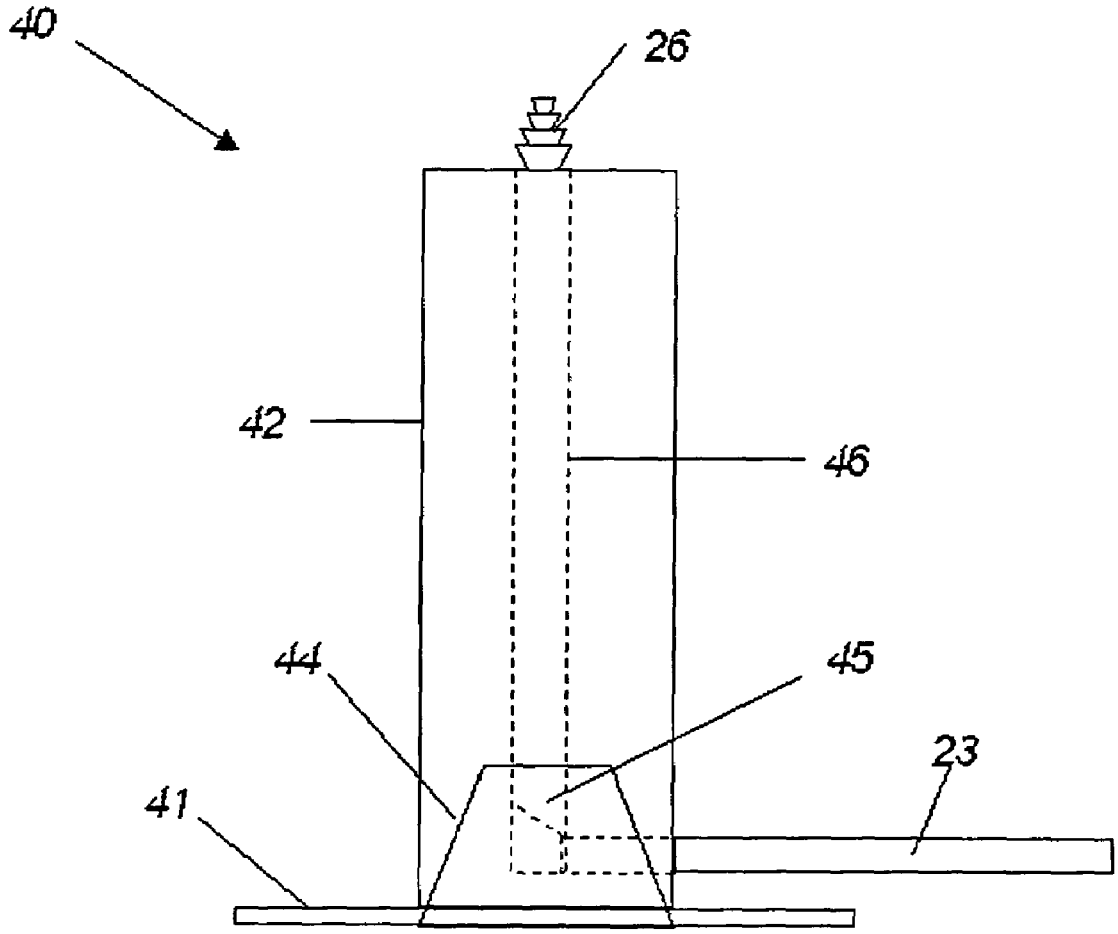
FIG. 2 is a side view of shaft portion of the present invention, showing placement of its air tube and monodirectional air flow valve.

Turning now descriptively to the drawings, in which similar reference characters denote similar elements throughout several views, FIGS. 1 through 6 illustrate a balloon bursting game 10, which comprises a pneumatic striker mechanism 20 for compressing air into an air tube 23 when struck or depressed, a vertical shaft comprised of a base structure 41 and housing 40, a balloon nozzle 24 and piercing frame 50 with piercing members 51 attached to the top of the vertical shaft, and an air tube 23 connected by a nozzle 22 from the striker mechanism through a monodirectional controlling valve 45 and housing 42 to the bottom end of the balloon nozzle 26. In use, with an uninflated balloon 60 secured to the balloon nozzle, a hammer 30 or similar object, or means of jumping up and down upon the striker mechanism, repeatedly depresses the pneumatic striker mechanism, forcing air through the tube, valve and nozzle into the balloon, so that the balloon expands to a size sufficient to press against the piercing members 51 and bursts.

Figure 3:
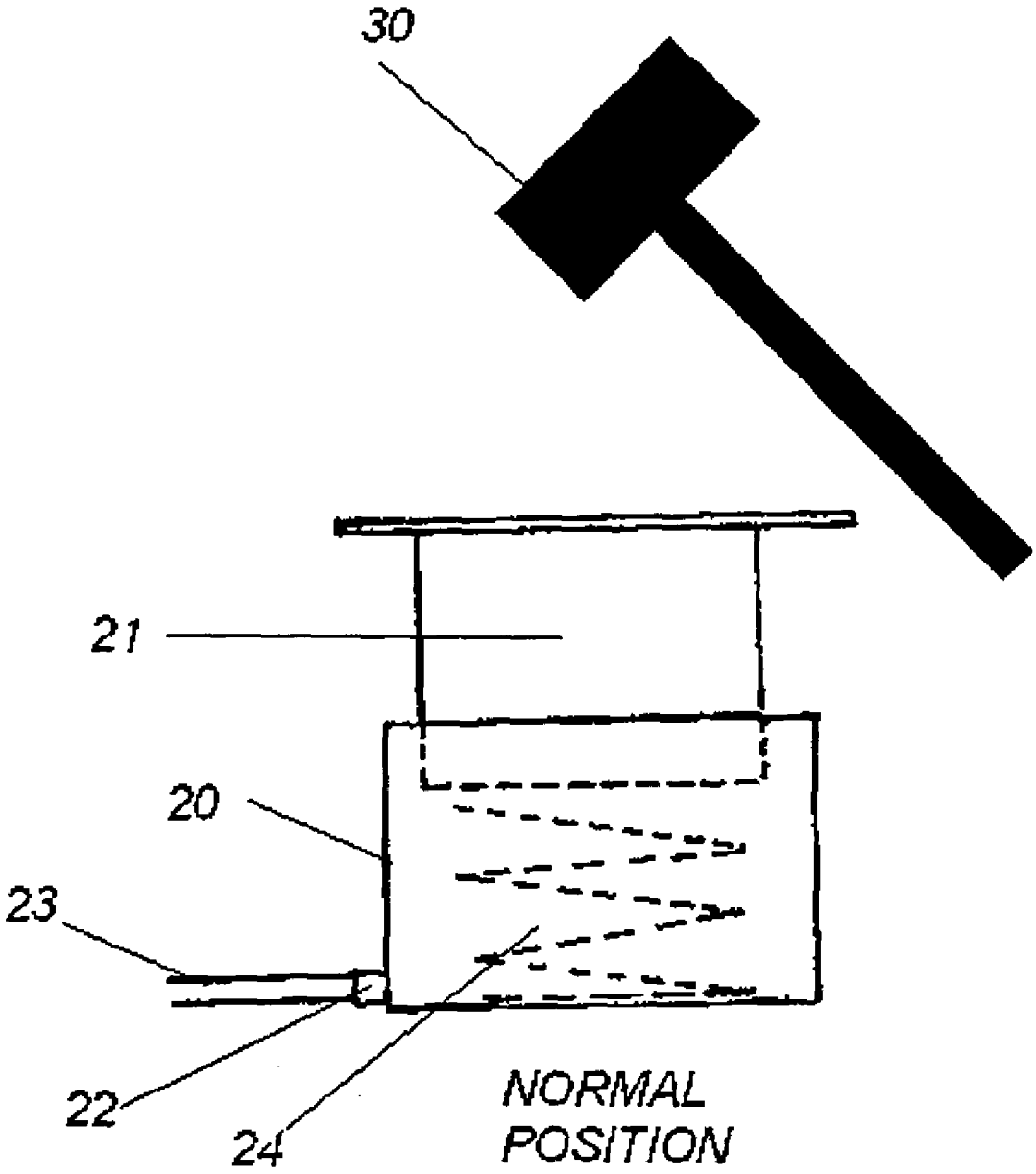
FIG. 3 is a side view of the pneumatic striker in its normal position.
Figure 4:
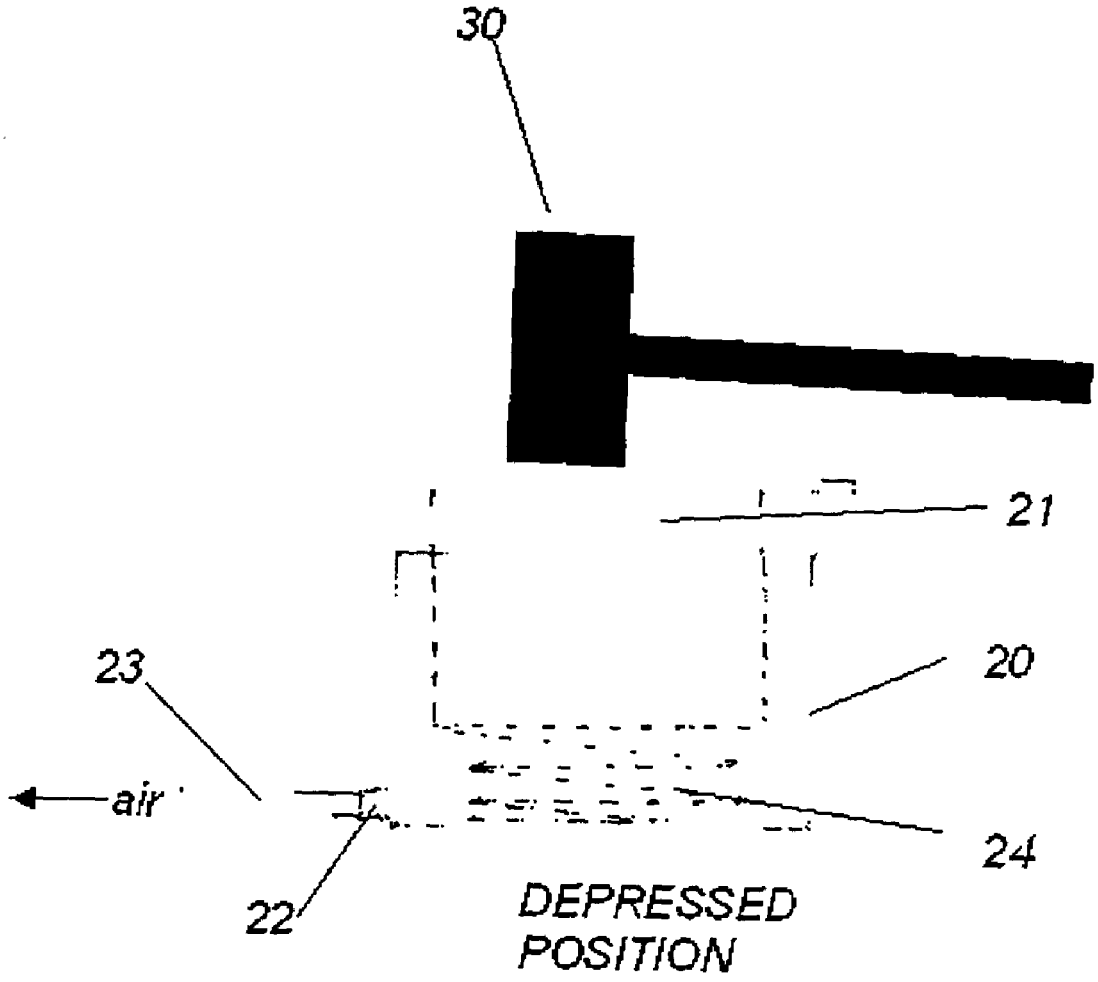
FIG. 4 is a side view of the striker in its depressed position.

As shown in FIGS. 1, 3 and 4 of the drawings, the pneumatic striker device 20 is a hard structure containing a spring 24 such that when the striker shaft 21 is struck to force air through the nozzle 22 into the air tube 23, the striker shaft returns to its former position. However it can be appreciated that a pneumatic striker device 20 may be comprised of various structures and shapes, including but not limited to bellows of any material, spring configurations or rubberized bulbs, to provide equivalent air compression functionality when depressed.

Figure 5:
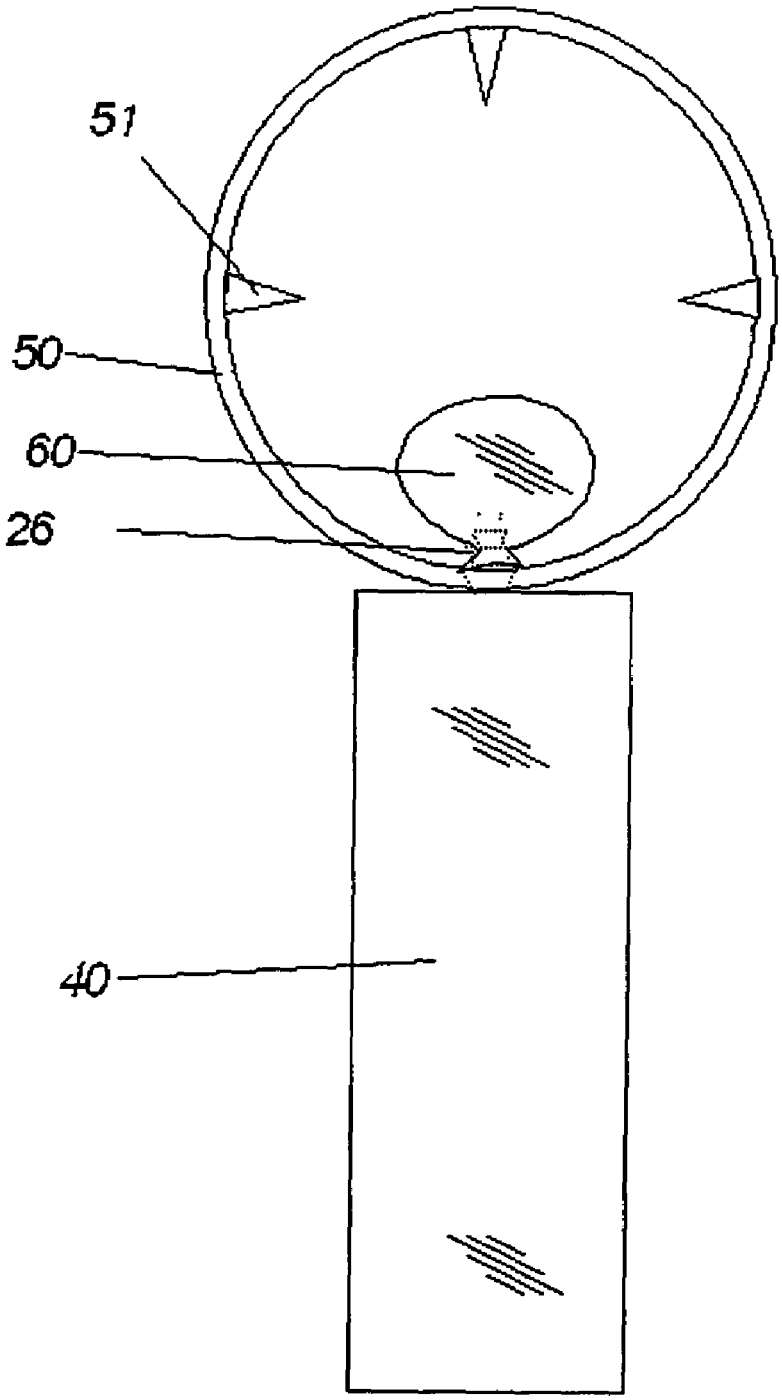
FIG. 5 shows the uninflated balloon on the balloon nozzle.
Figure 6:
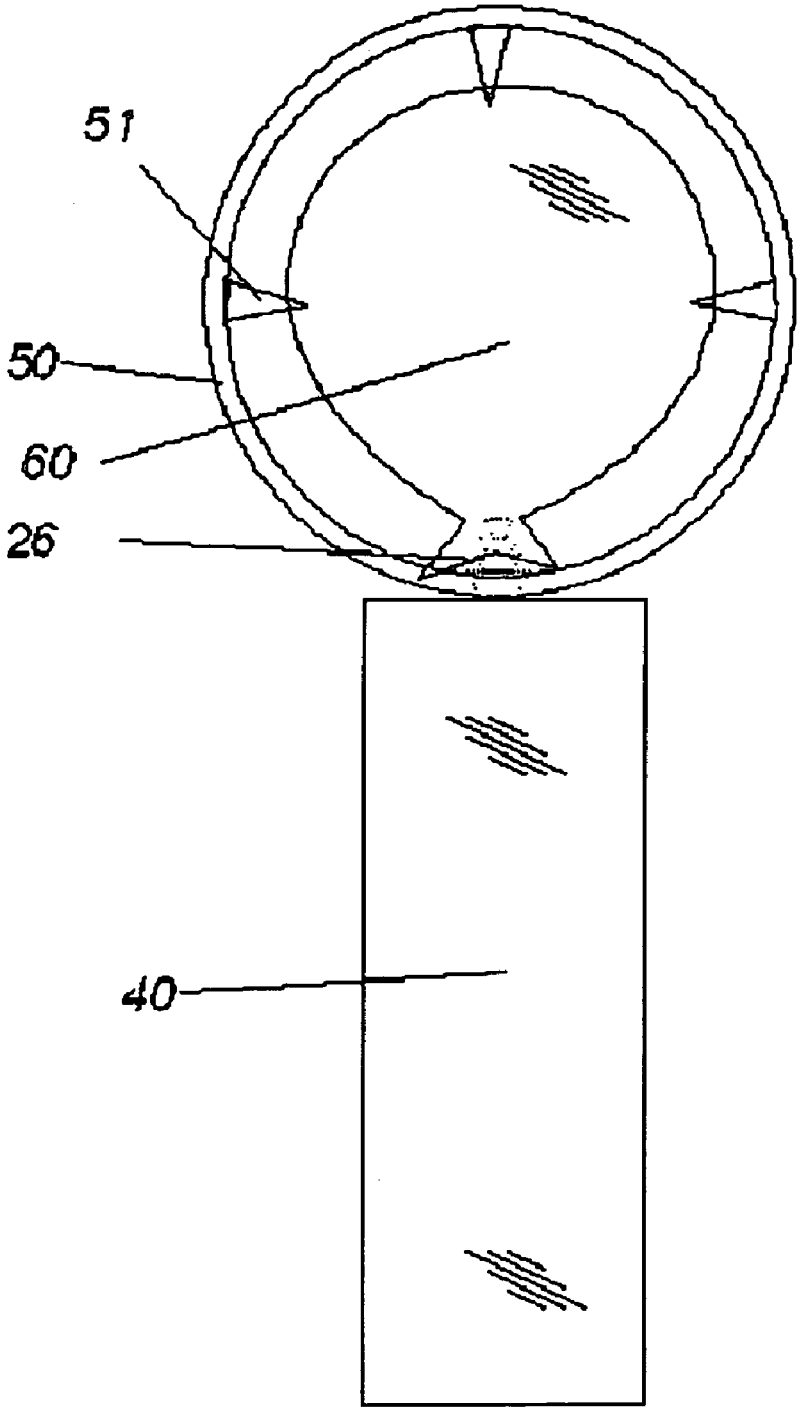
FIG. 6 shows the balloon, near fully inflated, pressing against the piercing members.

As shown in FIGS. 5 and 6 of the drawings a normal, empty balloon 60, typically made of latex, is used in playing the game. This is shown in its uninflated state in FIG. 5, and its inflated state just prior to bursting in FIG. 6. However it can be appreciated that the game may be played with inflatable members of many materials, shapes and sizes, as well as balloons or inflatable members containing other materials such as, but not limited to, confetti or flour, to provide visual excitement when burst.

As shown in FIGS. 3 and 4 of the drawings, the pneumatic striker device 20 has a "normal position" for leaving the balloon 60 in an uninflated state, or when the game is not being played as in FIG. 3, and a "depressed position" when it is depressed by the hammer or other striking device and sends air to the balloon, as in FIG. 4.

As shown in FIGS. 1, 5 and 6 of the drawings, the balloon piercing frame 50 is a round structure surrounding balloon with piercing members 51 placed at the middle circumference and top edge of the inflated balloon. However it can be appreciated that a balloon piercing frame may be comprised of various structures and shapes, so long as the bursting function is effectively provided.

As shown in FIGS. 1 and 3 of the drawings, a hammer or maul 30 may be used to strike and compress the pneumatic striker 20. However it can be appreciated that the striking object may be comprised of various structures and shapes including but not limited to hammers, mallets, mauls, and human hands and feet.

As shown in FIGS. 1, 2, 3 and 4 of the drawings, the nozzles 22, 24, air tubes 23, 46 and monodirection air flow valve 45 are configured at illustrated points to provide horizontal then vertical air flow. However various other configuration of air flow devices from the striker 20 to the balloon 60 may be utilized.

As to a further discussion of the manner of usage and operation of the present invention, the same should be apparent from the above description. Accordingly no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A balloon-bursting game, comprising:

a strikable pneumatic air chamber that, when struck or compressed, forces air through a venting aperture, a means of compressing said air chamber, a means of restoring the air chamber to its pre-compressed state, a balloon stand with balloon nozzle, a balloon piercing frame with sharpened members, a tube connecting the venting aperture to said balloon stand with balloon nozzle a control valve connected to said tube or said aperture to ensure one-way air flow from the chamber to the balloon whereby a balloon is gradually inflated each time the air chamber is compressed until surface of said balloon presses sufficiently against said balloon piercing frame to burst.

2. The balloon-bursting game of claim 1, wherein said strikable air chamber is of durable construction to facilitate repeated striking.

3. The balloon-bursting game of claim 2, wherein said strikable air chamber includes a means for pumping air through venting aperture and air tube when depressed, then quickly recovering to its normal position.

4. The balloon-bursting game of claim 2, wherein the air forced through the venting aperture and air tube progressively inflates the balloon to its capacity.

5. The balloon-bursting game of claim 1, wherein said means of compressing said air chamber is a hammer, maul or other member capable of sufficient force to compress said chamber.

6. The balloon-bursting game of claim 1, wherein said balloon piercing frame is positioned around the expected perimeter or circumference of an inflated balloon, and includes members sufficiently sharp to pierce and burst said balloon.

7. The balloon-bursting game of claim 6, wherein said balloon piercing frame is attached to the balloon stand.

8. The balloon-bursting game of claim 1, wherein said balloon may contain confetti, flour or other materials in its uninflated state, to provide visual excitement at the time of bursting.

* * * * *